US007497147B2

(12) United States Patent
Koppenhoefer

(10) Patent No.: US 7,497,147 B2
(45) Date of Patent: Mar. 3, 2009

(54) TORQUE TOOL FOR TIGHTENING OR LOOSENING CONNECTIONS, AND METHOD OF TIGHTENING OR LOOSENING THE SAME

(75) Inventor: Peter Koppenhoefer, Portland, PA (US)

(73) Assignee: Unex Corporation, Mahwah, NJ (US)

( * ) Notice: Subject to any disclaimer, the term of this patent is extended or adjusted under 35 U.S.C. 154(b) by 0 days.

(21) Appl. No.: 11/846,005

(22) Filed: Aug. 28, 2007

(65) Prior Publication Data

US 2008/0060482 A1 Mar. 13, 2008

Related U.S. Application Data

(60) Provisional application No. 60/844,060, filed on Sep. 12, 2006.

(51) Int. Cl.
*B25B 13/46* (2006.01)

(52) U.S. Cl. ..... 81/57.39; 81/57.44

(58) Field of Classification Search ..... 81/57.39, 81/57.44, 55

See application file for complete search history.

(56) References Cited

U.S. PATENT DOCUMENTS

| | | | | | |
|---|---|---|---|---|---|
| 3,198,040 | A * | 8/1965 | Franck | ..... | 81/55 |
| 4,200,011 | A * | 4/1980 | Wilmeth | ..... | 81/57.39 |
| 4,336,727 | A * | 6/1982 | Junkers | ..... | 81/57.39 |
| 4,706,527 | A * | 11/1987 | Junkers | ..... | 81/57.39 |
| 4,825,730 | A | 5/1989 | Junkers | | |
| 4,854,197 | A * | 8/1989 | Walton | ..... | 81/57.39 |
| 4,974,476 | A | 12/1990 | Junkers | | |
| 5,301,574 | A * | 4/1994 | Knopp et al. | ..... | 81/57.39 |
| 5,823,075 | A * | 10/1998 | Torrekens | ..... | 81/57.39 |
| 6,029,546 | A | 2/2000 | Gibson et al. | | |
| 6,370,987 | B1 | 4/2002 | Wilson | | |
| 6,490,952 | B2 * | 12/2002 | Junkers | ..... | 81/57.39 |
| 6,912,933 | B2 * | 7/2005 | Knopp et al. | ..... | 81/57.39 |
| 7,082,858 | B2 * | 8/2006 | Knopp et al. | ..... | 81/57.39 |
| 7,146,880 | B1 * | 12/2006 | Francis et al. | ..... | 81/57.39 |
| 2002/0073808 | A1 * | 6/2002 | Jamra et al. | ..... | 81/57.39 |
| 2002/0121161 | A1 | 9/2002 | Koppenhoefer | | |

FOREIGN PATENT DOCUMENTS

| | | | |
|---|---|---|---|
| EP | 0 382 408 | | 8/1990 |
| EP | 0 382 961 | | 8/1990 |
| EP | 1 325 794 | | 7/2003 |
| EP | 1 559 512 | | 8/2005 |
| JP | 02237774 | A * | 9/1990 |
| PL | 117029 | | 7/1982 |
| PL | 180566 | | 1/1996 |
| PL | 185984 | | 3/1998 |
| PL | 188564 | | 7/1999 |

* cited by examiner

*Primary Examiner*—David B Thomas
(74) *Attorney, Agent, or Firm*—Michael J. Striker

(57) ABSTRACT

A torque tool for tightening or loosening connections has a driving element engageable with a turnable part of the connection for turning the turnable part of the connection for tightening or loosening the connection and turnable about an axis, and a power drive configured for acting on the driving element such that the drive acts on the driving element to turn the driving element and thereby to turn the turnable part of the connection over a partial stroke and a space is formed between the drive and the driving element, and the drive is then displaced over the space toward the driving element to act again on the driving element to turn the driving element and thereby to further turn the turnable part of the connection over a further partial stroke.

16 Claims, 8 Drawing Sheets

TORQUE TOOL FOR TIGHTENING OR LOOSENING CONNECTIONS, AND METHOD OF TIGHTENING OR LOOSENING THE SAME

CROSS-REFERENCE

This application claims the benefit of U.S. Provisional Patent Application Ser. No. 60/844,060 filed Sep. 12, 2006, under 35 U.S.C. 119(e). The subject matter of aforesaid U.S. Provisional Patent Application is further explicitly incorporated herein by reference thereto.

BACKGROUND OF THE INVENTION

The present invention relates to a torque tool for tightening or loosening a connection, as well as a method for tightening or loosening the same.

In the known prior art, the tightening and loosening of connections such as on gas turbines or gas pipelines is typically accomplished with the use of hand wrenches. Two wrenches are typically used, one to hold the fitting area in place, and the second wrench is used to tighten or loosen the bolt.

In normal applications, the force to be applied by a typical hand operated wrench is insufficient to either tighten or loosen an industrial bolt. Additionally, such bolt connections are often inaccessible or surrounded by other industrial equipment such as pipes and gauges and electrical fittings and the like. Such environmental fittings and pipes render it difficult to safely manipulate hand wrenches in the immediate area.

Additionally, it is often the case that in view of surrounding equipment and the like, it is not possible to manipulate a hand wrench in the proximity of the bolt to be turned. Under such situations it is necessary to extend the length of the hand wrench by inserting thereon a length of a pipe which surrounds the handle of the wrench and effectively extends it therefrom.

Thus, in a typical prior art application it is sometimes necessary to manipulate two hand wrenches each extended through the use of a length of pipe, so that the wrenches will be extended through the surrounding area to tighten or loosen a bolt.

Such a procedure is both difficult and tedious, as well as potentially dangerous in view of possible damage to surrounding equipment such as pipelines or electrical fittings or the like.

It is therefore believed to be clear that it is advisable to provide an approved tool and method for tightening and loosening of such connections.

SUMMARY OF THE INVENTION

Accordingly, it is an object of the present invention to provide a torque tool for tightening or loosening a connection as well as to a method for tightening or loosening the same, which avoid the disadvantages of the prior art.

In keeping with these objects and with others which will become apparent hereinafter, one feature of the present invention resides, briefly stated, in a torque tool for tightening or loosening connections, comprising a driving element engageable with a turnable part of the connection for turning the turnable part of the connection for tightening or loosening the connection and turnable around an axis; and a power drive configured for acting on said driving element such that said drive acts on said driving element to turn said driving element and thereby to turn the turnable part of the connection over a partial stroke and a space is formed between said drive and said driving element, and said drive is then displaced over said space toward said driving element to act again on said driving element to turn said driving element and thereby to further turn the turnable part of the connection over a further partial stroke.

Another feature of the present invention resides, briefly stated, in a method of tightening or loosening connections, comprising engaging a driving element with a turnable part of the connection for turning the turnable part of the connection for tightening or loosening the connection and turnable around an axis; acting by a power drive on said driving element such that said drive acts on said driving element to turn said driving element and thereby to turn the turnable part of the connection over a partial stroke and a space is formed between said drive and said driving element; displacing said drive over said space toward said driving element; and acting again by said drive on said driving element to turn said driving element and thereby to further turn the turnable part of the connection over a further partial stroke.

When the torque tool is designed and the method is performed in accordance with the present invention, it allows reliable, safe, and efficient tightening or loosening of corresponding connections, such as for example gas line connections on gas turbines, and the like.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
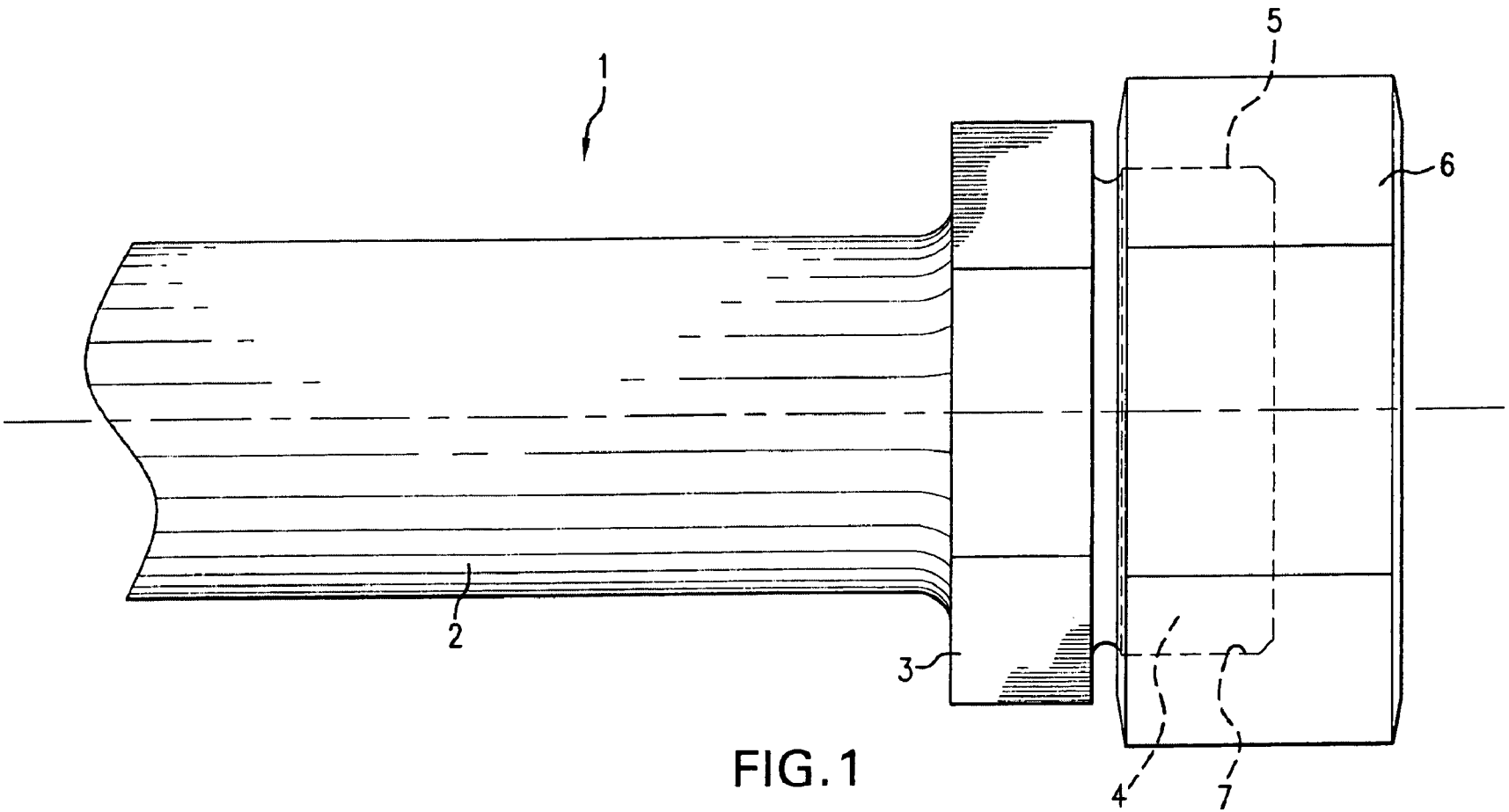
FIG. 1 is a view schematically showing a pipe fitting which is to be tightened or loosened by a torque tool and by a method in accordance with the present invention.
Figure 2:
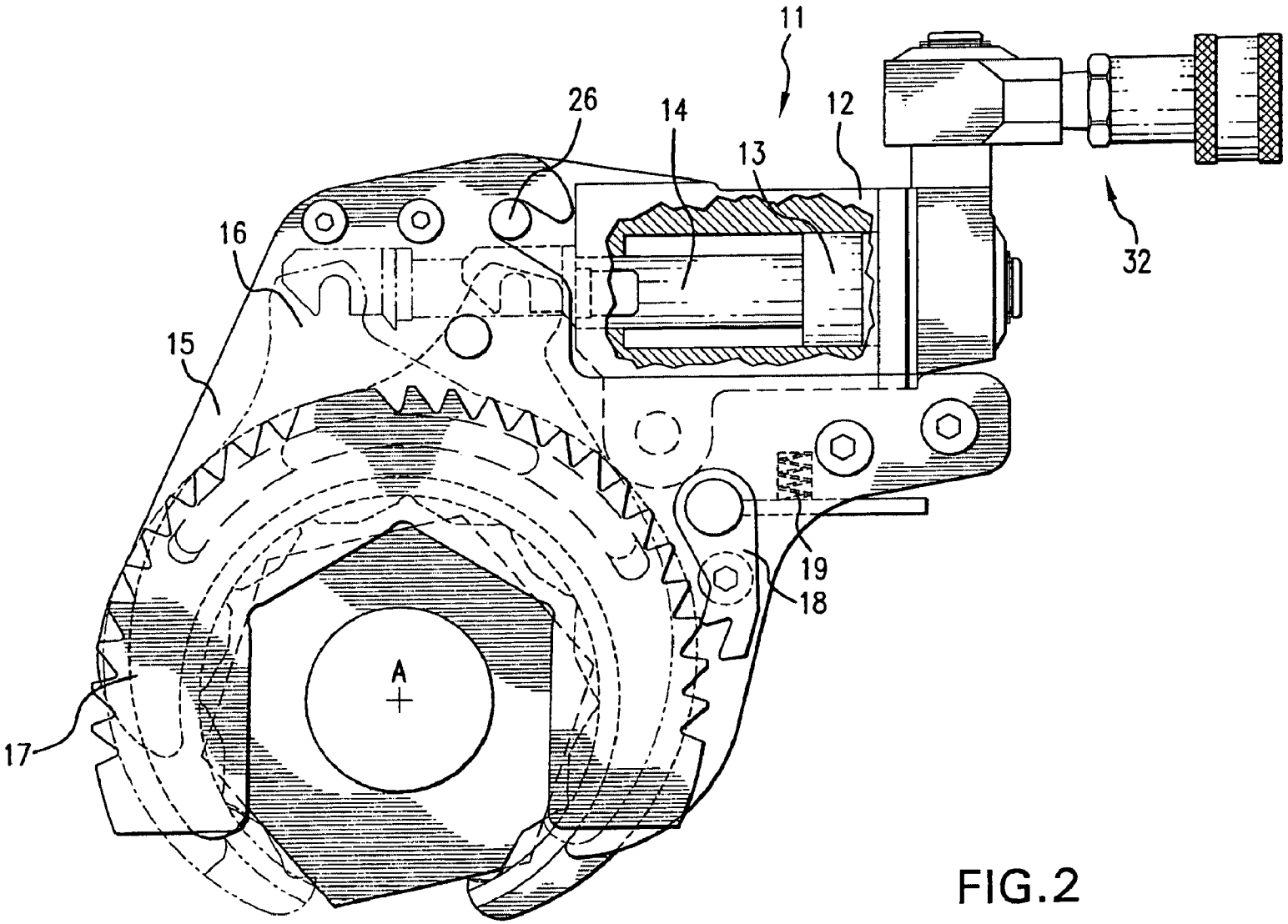
FIG. 2 is a side view of a torque tool for tightening or loosening connections in accordance with the present invention.
Figure 3:
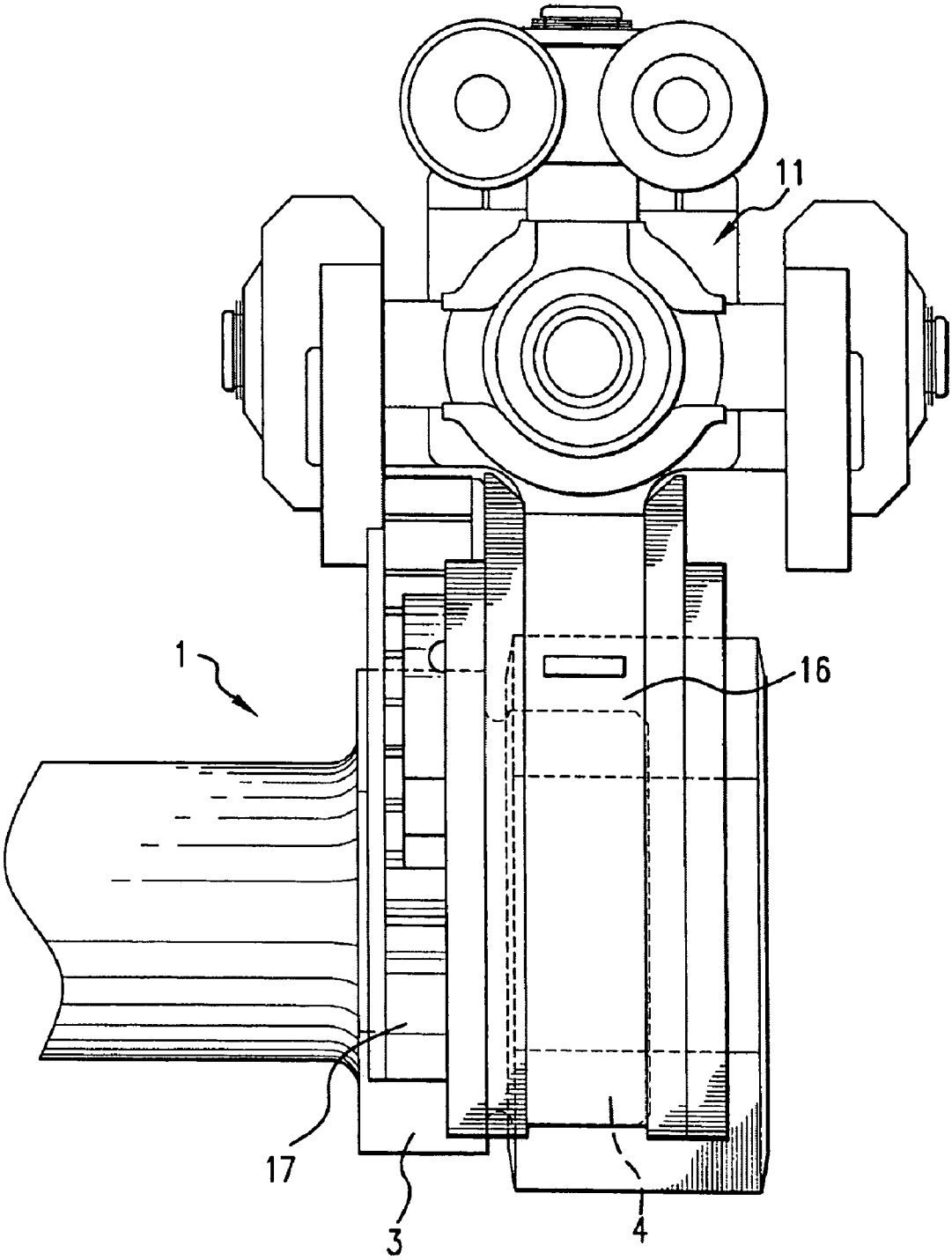
FIG. 3 is an end view of the torque tool for tightening or loosening connections in accordance with the present invention.

A torque tool for tightening or loosening connections and a method for tightening or loosening of the same in accordance with the present invention can be used, for example, for tightening or loosening a pipe fitting shown in FIG. 1 and identified with reference numeral 1. The pipe fitting has a pipe element 2 provided with a non-turnable, shaped part formed for example as a hexagonal part 3, and a head 4 provided with an outer thread 5. A nut 6 having an inner thread 7 has to be tightened on the head 4 by turning on the latter.

The torque tool in accordance with the present invention has a drive which is identified as a whole with reference numeral 11 and can be formed as a fluid-operated drive including a cylinder 12 and a piston 13 with a piston rod 14 movable in the cylinder. The drive 11 is immovably connected with two side plates 15. The cylinder 12 of the drive 11 and the side plates 15 together form a stationary part of the torque tool, which does not turn during turning of the nut 6 of the pipe fitting 1.

A driving element of the torque tool is formed, for example, by a drive plate 16 which is located between the side plates 15 and is turnable around an axis A under the action of the piston rod 14 of the drive 11, which applies an action force to the drive plate 16 when the piston rod 14 is extended from the cylinder 12 of the drive 11.

The torque tool further has a reaction element which is engageable with a non-turnable part of the connection, in particular with the part 3 to counteract a reaction force which is generated during turning of the turnable part 6 of the connection by the driving plate 16 and thereby to prevent turning of the tool backward while the nut 6 is turned forward. The reaction element is formed, for example, as a reaction plate 17 which cooperates with a holding pawl 18. The holding pawl 18 is turnably mounted on the immovable part of the torque tool. For example one such holding pawl 18 is mounted on each side plate 15. Each holding pawl 18 is spring-biased by a spring 19 toward the reaction plate 17.

Figure 5B:
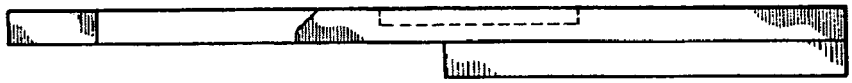
FIGS. 5*a* and 5*b* are a side view and an end view of a side plate of the torque tool in accordance with the present invention.
Figure 5A:
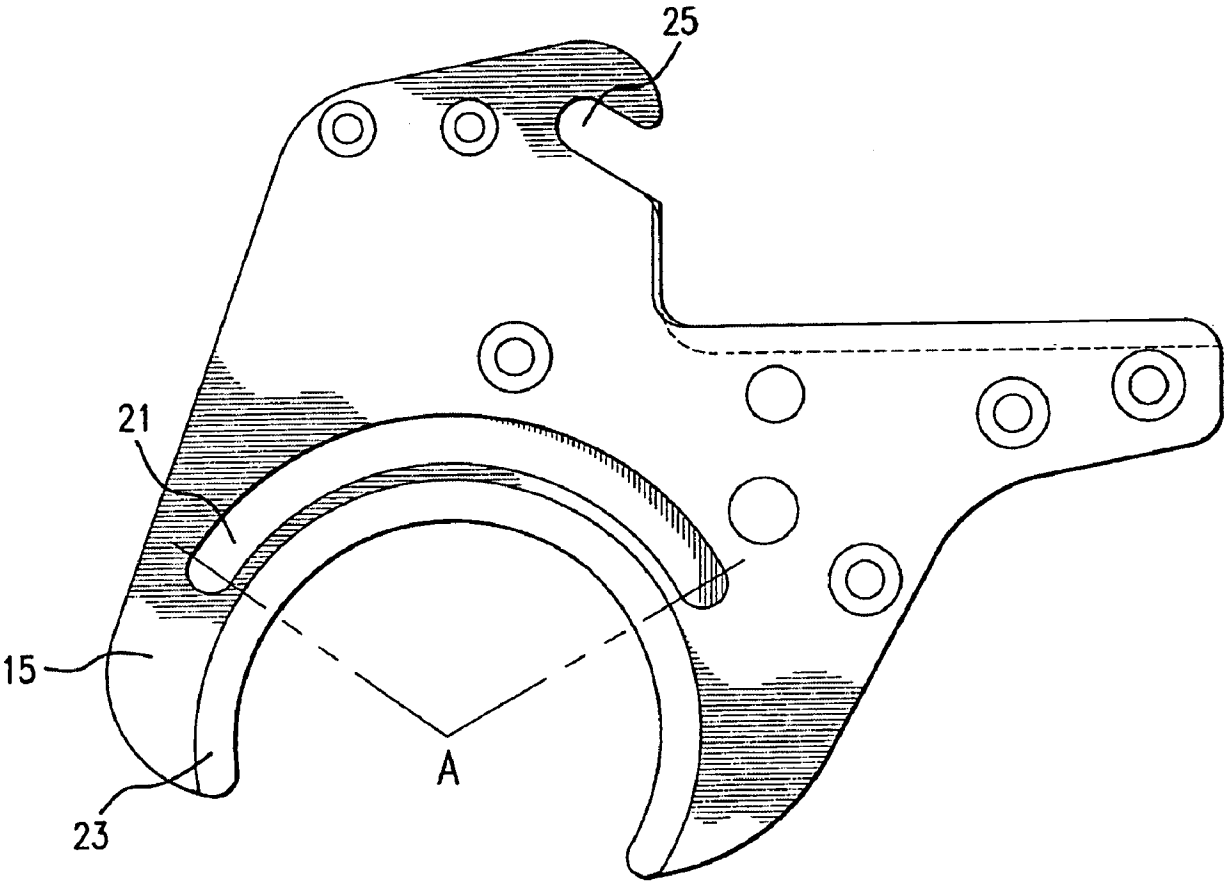
Figure 6B:
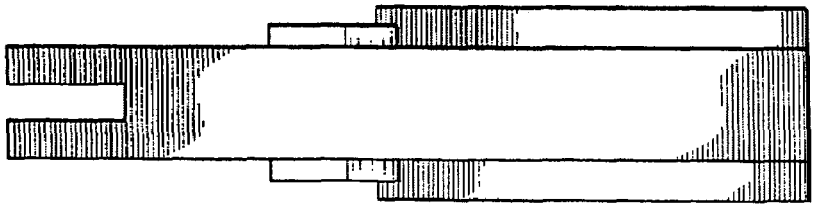
FIGS. 6*a* and 6*b* are a side view and an end view of a drive plate of the torque tool in accordance with the present invention.
Figure 6A:
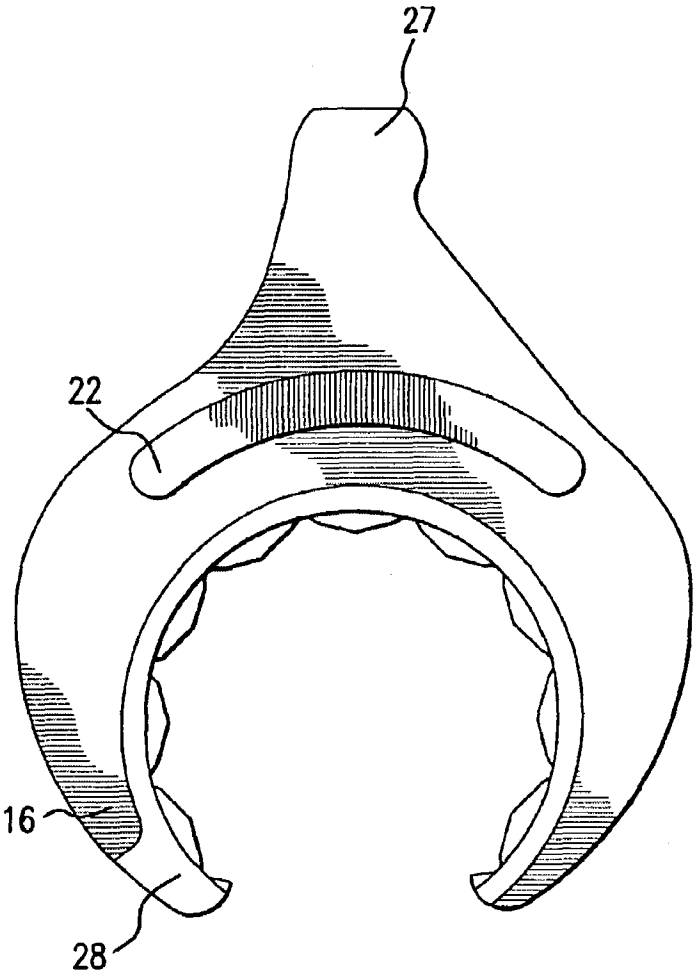
Figure 7B:
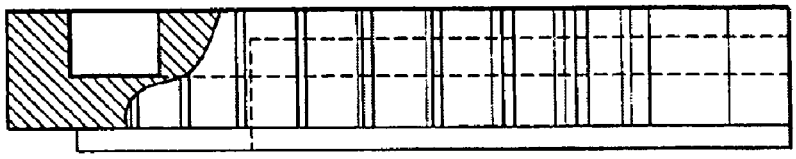
FIGS. 7*a* and 7*b* are a side view and an end view of a reaction plate of the torque tool in accordance with the present invention.
Figure 7A:
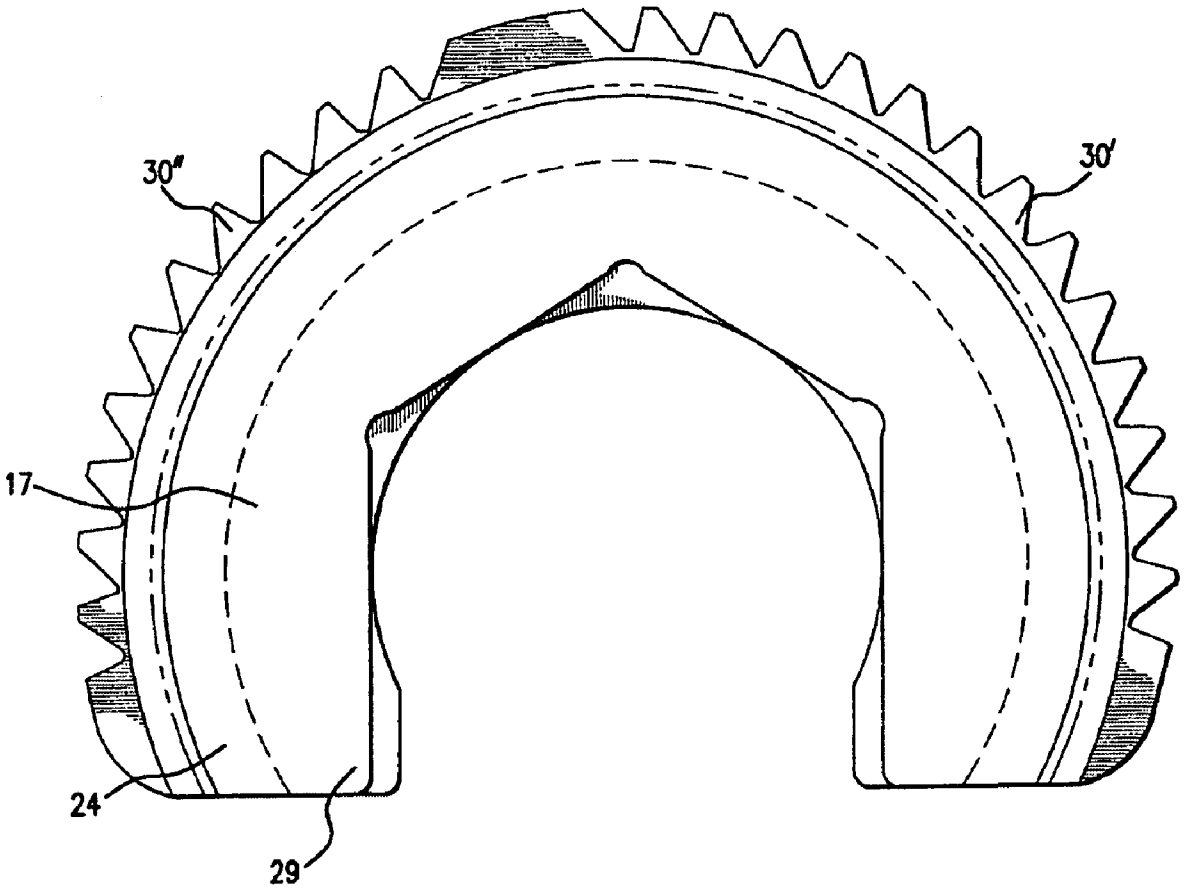
Figure 8B:
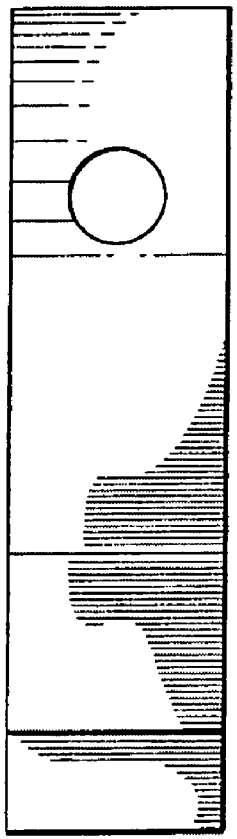
FIGS. 8*a* and 8*b* are a side view and an end view of a holding pawl of the torque tool in accordance with the present invention.
Figure 8A:
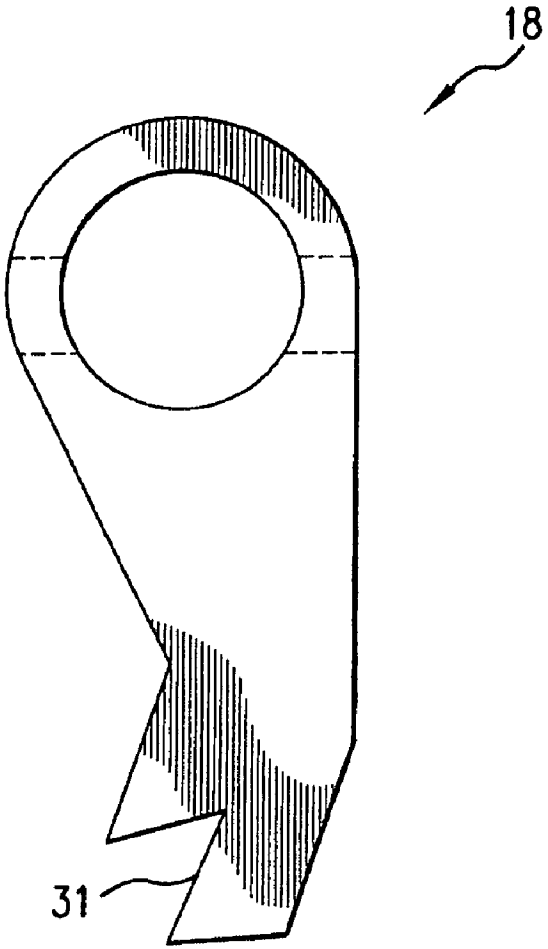

As shown in FIGS. 5*a* and 5*b*, each side plate 15 has a groove 21 which is provided on one side of the side plate and extends circumferentially around the axis A over a certain angle. A correspondingly shaped projection 22 of the drive plate 16 slidingly engages in the groove 21 of the side plate 15.

The side plate 15 further has a projection 23 provided on the opposite side and extending in a circumferential direction around the axis A. The projection 23 of the side plate 15 slidingly engages in a corresponding groove 24 provided in the reaction plate 17. The side plates 15 are immovably connected with the drive 11, for example, by a groove 25 provided in each side plate 15 and a projection 26 provided on the drive 11.

The drive plate 16 has a portion 27 cooperating with the piston rod 14 of the drive 11 for turning the drive plate 16 during a working stroke of the tool. It also has an oppositely located engaging portion 28 which is provided with a polygonal receptacle, formed, for example, as a 12-points receptacle. The engaging portion 28 with its polygonal receptacle engages over the nut 6 of the connection to be tightened or loosened.

The reaction plate 17 has a portion 29 provided with an inner polygonal receptacle, formed, for example, as a substantially hexagonal receptacle with lips. During the operation the portion 29 is placed with its polygonal receptacle on the non-turnable part 3 of the connection for reaction purposes, as will be explained herein above.

On an outer periphery the reaction plate 17 has two sets of formations, formed, for example, as inclined teeth 30' and 30". The holding pawl 18 has an engaging portion 31 which is engageable with the teeth 30' or 30" to hold the reaction plate 17 from turning during the working stroke of the torque tool, and for ratcheting over the teeth of the reaction plate 17 during a non-working stroke of the torque tool.

The two pawls 18 located on opposite axial sides can be turnably connected with the side plates 15, for example, by a pin extending through aligned openings provided in the holding pawls 18 and in the side plates 15.

The torque tool further has a fluid supply system provided for the fluid-operated drive 11 and identified as a whole with reference numeral 32.

The torque tool for tightening or loosening connections in accordance with the present invention operates in accordance with the inventive method of tightening or loosening connections in the following manner.

When it is necessary to turn the nut 6, for example, for tightening the nut 6 on the part 4 of the connection 1, a fluid is supplied into the fluid-operated drive 11, the piston 13 is displaced so that the piston rod 14 is extended, the piston rod 14 acts on the drive plate 16 by an action force for example to push the drive plate 16, and turns the drive plate 16, which with its part 26 turns the nut 6.

During turning of the drive plate 16 the holding pawl 18 mounted on the immovable part on the tool, for example on the side plate 15, engages the corresponding teeth of the reaction plate 17, so that while an action force is transmitted by the drive plate 16 to the nut 6, a reaction force generated during turning is transmitted through the side plate 15, the holding pawl 18, and the reaction plate 17 to the non-turnable part 3 of the connection to prevent turning of the torque tool in an opposite direction.

The drive plate 16 and correspondingly the nut 6 perform a partial stroke, and the nut 6 is turned over a predetermined angle, for example 20-30°. To turn the nut 6 further, the immovable part of the tool, for example the cylinder 12 of the drive 11 and the side plates 15, are displaced towards the drive plate 16. During this displacement the holding pawl 8 ratchets over the corresponding teeth of the reaction plate 17.

Then the drive 11 is activated again, and the piston rod 14 is extended from the cylinder 12 to act again on the drive plate 16 and to turn the drive plate 16 in a further stroke over a further angle. During this stage the same process takes place, namely the action force provided by the drive 11 is applied by the drive plate 16 to the nut 6 of the connection, while the reaction force is transmitted through the side plate 15, the pawl 18, and the reaction plate 17 to the non-turnable part 3 of the connection.

Figure 4:
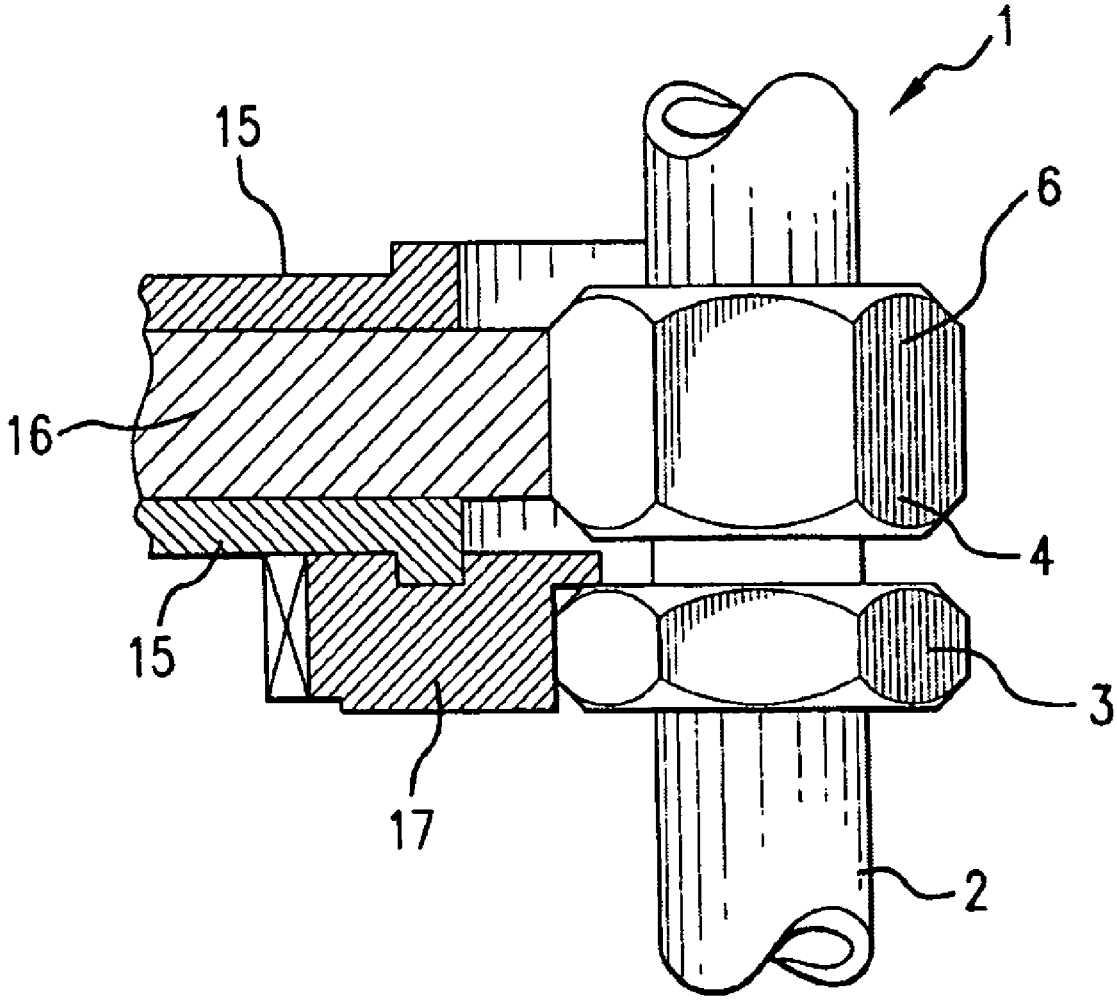
FIG. 4 is a schematic view showing the torque tool for tightening or loosening connections in accordance with the present invention as applied on the pipe fitting for tightening or loosening the same.

The reaction plate 17 is removable from the corresponding side plate. It can be located on one axial side of the side plates 15 as shown in FIG. 4, for example, for tightening of the connection. Then, it can be removed and placed on the opposite side of the side plates 15, for example, for loosening the connection. While in the first position, the holding pawl 18 cooperates with one set of teeth, for example the teeth 30' of the reaction plate 17, in the second position when the reaction plate is placed on the opposite side of the side plates 15 the pawl 18 cooperates with the other set of teeth, for example the teeth 30", of the reaction plate 17. The teeth 30' and 30" can be inclined to provide holding of the reaction plate 17 by the pawl 18 during turning of the nut 6, and to allow ratcheting of the pawl 18 over the teeth during the displacement of the cylinder 12 of the drive 11 with the side plates 15 towards the drive plate 16.

It will be understood that each of the elements described above, or two or more together, may also find a useful application in other types of constructions differing from the type described above.

While the invention has been illustrated and described as embodied in a torque tool for tightening or loosening a connection as well as to a method for tightening or loosening the same, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

The invention claimed is:

1. A torque tool for tightening or loosening connections, comprising a driving element engageable with a turnable part of the connection for turning the turnable part of the connection for tightening or loosening the connection and turnable around an axis; a power drive configured for acting on said driving element such that said drive acts on said driving element to turn said driving element and thereby to turn the turnable part of the connection over a partial stroke and a space is formed between said drive and said driving element, and said drive is then displaced over said space toward said driving element to act again on said driving element to turn said driving element and thereby to further turn the turnable part of the connection over a further partial stroke; and a reaction element engageable with a non-turnable part of the connection and configured such that when said driving element is turned by said drive and turns the turnable part of the connection by an action force, said reaction element counteracts a reaction force generated during turning of the turnable part of the connection, wherein said stationary part and said reaction element are configured so that during turning of the turnable part of the connection by said driving element said stationary part and said reaction element are non-turnable relative to one another, while during the displacement of said drive toward said driving element over said space said stationary part is movable relative to said reaction element with a ratcheting action.

2. A torque tool as defined in claim 1, wherein said drive is configured as a fluid-operated drive including a cylinder and a piston with a piston rod movable in said cylinder such that said piston rod is extended from said cylinder and acts on said driving element to turn said driving element and thereby to turn the turnable part of the connection over said partial stroke, then said cylinder is displaced over said space toward said driving element, and thereafter said piston rod is extended again from said cylinder toward said driving element to act again on said driving element to turn said driving element and thereby to further turn the turnable part of the connection over said further partial stroke.

3. A torque tool as defined in claim 1, wherein said stationary part including an element which is a part of said drive and an element relative to which said driving element is turnable.

4. A torque tool as defined in claim 1, further comprising means for holding said stationary part and said reaction element immovable relative to one another when said driving element is turned by said drive and turns the turnable part of the connection, but allowing a movement of said stationary part relative to said reaction element when said drive is displaced toward said driving element.

5. A torque tool as defined in claim 4, wherein said holding means including a holding pawl mounted on one of said stationary part and said reaction element, and tooth means provided on the other of said stationary part and said reaction element and configured such that said holding pawl engages said tooth means to hold said stationary part and said reaction element immovable relative to one another during turning of said driving element by said drive, but allows ratcheting of said holding pawl over said tooth means when said drive is displaced toward said driving element.

6. A torque tool as defined in claim 1, wherein said reaction element is removably connected with said stationary part and configured such that it is mountable alternatingly on one axial side of said stationary part or on another axial side of said stationary part.

7. A torque tool for tightening or loosening connections, comprising a driving element engageable with a turnable part of the connection for turning the turnable part of the connection for tightening or loosening the connection and turnable around an axis; a power drive configured for acting on said driving element such that said drive acts on said driving element to turn said driving element and thereby to turn the turnable part of the connection over a partial stroke and a space is formed between said drive and said driving element, and said drive is then displaced over said space toward said driving element to act again on said driving element to turn said driving element and thereby to further turn the turnable part of the connection over a further partial stroke; a reaction element engageable with a non-turnable part of the connection and configured such that when said driving element is turned by said drive and turns the turnable part of the connection by an action force, said reaction element counteracts a reaction force generated during turning of the turnable part of the connection; and a stationary part which is stationary during turning of said driving element, said stationary part including an element which is a part of said drive and an element relative to which said driving element is driveable, wherein said driving element and said stationary part are provided with means allowing turning of said driving element relative to said stationary part, said means including interacting projection and groove means engageable with one another and slidable relative to one another around said axis.

8. A torque tool for tightening or loosening connections, comprising a driving element engageable with a turnable part of the connection for turning the turnable part of the connection for tightening or loosening the connection and turnable around an axis; a power drive configured for acting on said driving element such that said drive acts on said driving element to turn said driving element and thereby to turn the turnable part of the connection over a partial stroke and a space is formed between said drive and said driving element, and said drive is then displaced over said space toward said driving element to act again on said driving element to turn said driving element and thereby to further turn the turnable part of the connection over a further partial stroke; and a reaction element engageable with a non-turnable part of the connection and configured such that when said driving element is turned by said drive and turns the turnable part of the connection by an action force, said reaction element counteracts a reaction force generated during turning of the turnable part of the connection, wherein said stationary part and said reaction element has means allowing turning of said stationary part relative to said reaction element and including interengaging projection and groove means slidable relative to one another around said axis.

9. A method of tightening or loosening connections, comprising engaging a driving element with a turnable part of the connection for turning the turnable part of the connection for tightening or loosening the connection and turnable around an axis; acting by a power drive on said driving element such that said drive acts on said driving element to turn said driving element and thereby to turn the turnable part of the connection over a partial stroke and a space is formed between said drive and said driving element; displacing said drive over said space toward said driving element; acting again by said drive on said driving element to turn said driving element and thereby to further turn the turnable part of the connection over a further partial stroke; and providing a reaction element engageable with a non-turnable part of the connection and configured such that when said driving element is turned by said drive and turns the turnable part of the connection by an action force, said reaction element counteracts a reaction force generated during turning of the turnable part of the connection, further comprising configuring said stationary part and said reaction element so that during turning of the turnable part of the connection by said driving element said stationary part and said reaction element are non-turnable relative to one another while during the displacement of said drive toward said driving element over said space said stationary part is movable relative to said reaction element with a ratcheting action.

10. A method as defined in claim 9, further comprising forming said drive as a fluid-operated drive including a cylinder and a piston with a piston rod movable in said cylinder, extending said piston rod from said cylinder to act on said driving element to turn said driving element and thereby to turn the turnable part of the connection over said partial stroke; displacing said cylinder over said space toward said driving element; and extending said piston rod again from said cylinder toward said driving element to act again on said driving element to turn said driving element and thereby to further turn the turnable part of the connection over said further partial stroke.

11. A method as defined in claim 9, further comprising including in said stationary part an element which is a part of said drive and an element relative to which said driving element is turnable.

12. A method as defined in claim 9, further comprising providing means for holding said stationary part and said reaction element immovable relative to one another when said driving element is turned by said drive and turns the turnable part of the connection, but allowing a movement of said stationary part relative to said reaction element when said drive is displaced toward said driving element.

13. A method as defined in claim 12, further comprising forming said holding means as a holding pawl mounted on one of said stationary parts and said reaction element, and tooth means provided on the other of said stationary part and said reaction element and configured such that said holding pawl engages said tooth means to hold said stationary part and said reaction element non-turnable relative to one another during turning of said driving element by said drive, but allows ratcheting of said holding pawl over said tooth means when said drive is displaced toward said driving element.

14. A method as defined in claim 9, further comprising connecting said reaction plate removably with said stationary part such that it is mountable alternatingly on one axial side of said stationary part or on another axial side of said stationary part.

15. A method of tightening or loosening connections, comprising engaging a driving element with a turnable part of the connection for turning the turnable cart of the connection for tightening or loosening the connection and turnable around an axis; acting by a power drive on said driving element such that said drive acts on said driving element to turn said driving element and thereby to turn the turnable part of the connection over a partial stroke and a space is formed between said drive and said driving element; displacing said drive over said space toward said driving element; acting again by said drive on said driving element to turn said driving element and thereby to further turn the turnable part of the connection over a further partial stroke; providing a reaction element engageable with a non-turnable part of the connection and configured such that when said driving element is turned by said drive and turns the turnable part of the connection by an action force, said reaction element counteracts a reaction force generated during turning of the turnable part of the connection; providing a stationary part which is stationary during turning of said driving element, and including in said stationary part an element which is a part of said drive and an element relative to which said driving element is drivable; and providing said driving element and said stationary part with means allowing turning of said driving element relative to said stationary part and including interacting projection and groove means engageable with one another and slidable relative to one another around said axis.

16. A method of tightening or loosening connections, comprising engaging a driving element with a turnable part of the connection for turning the turnable part of the connection for tightening or loosening the connection and turnable around an axis; acting by a power drive on said driving element such that said drive acts on said driving element to turn said driving element and thereby to turn the turnable part of the connection over a partial stroke and a space is formed between said drive and said driving element; displacing said drive over said space toward said driving element; acting again by said drive on said driving element to turn said driving element and thereby to further turn the turnable part of the connection over a further partial stroke; and providing a reaction element engageable with a non-turnable part of the connection and configured such that when said driving element is turned by said drive and turns the turnable part of the connection by an action force, said reaction element counteracts a reaction force generated during turning of the turnable part of the connection, further comprising providing said stationary part and said reaction element with means allowing turning of said stationary part relative to said reaction element and including interengaging projection and groove means slidable relative to one another around said axis.

* * * * *